US007342189B2

(12) United States Patent
Bravard et al.

(10) Patent No.: US 7,342,189 B2
(45) Date of Patent: Mar. 11, 2008

(54) ACTUATING DEVICE FOR AN ELECTRICAL SWITCH DEVICE WITH ROTATIONAL LOCKING MEANS

(75) Inventors: Lionel Bravard, Peschadoires (FR); Yew Keong Clarence Chan, Singapore (SG); Wai Luen Eugene Cheong, Singapore (SG); Kok Kiong Low, Singapore (SG); Jean-Marie Periot, Triel-sur-Seine (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 92 days.

(21) Appl. No.: 11/383,285

(22) Filed: May 15, 2006

(65) Prior Publication Data

US 2006/0278516 A1 Dec. 14, 2006

(30) Foreign Application Priority Data

Jun. 14, 2005 (FR) ..... 05 51606

(51) Int. Cl.
*H01H 9/28* (2006.01)

(52) U.S. Cl. ..... 200/43.08; 200/43.01

(58) Field of Classification Search ..... 200/43.11, 200/336, 43.12, 338, 43.16, 330, 50.01, 331, 200/50.06, 318, 50.11, 43.01
See application file for complete search history.

(56) References Cited

U.S. PATENT DOCUMENTS 5,455,743 A * 10/1995 Miyajima ..... 361/781
5,473,127 A * 12/1995 Falcon et al. ..... 200/43.04
6,423,912 B1 * 7/2002 Arenz et al. ..... 200/43.08
6,797,903 B1 9/2004 Winslett et al.
6,872,898 B2 * 3/2005 Mohtasham ..... 200/43.01
2004/0069602 A1 * 4/2004 Mohtasham ..... 200/43.01
2004/0173442 A1 * 9/2004 Jorgensen et al. ..... 200/43.01

FOREIGN PATENT DOCUMENTS

DE 43 22 214 A1 1/1995
EP 0 450 699 A2 10/1991
EP 0 472 477 A1 2/1992
EP 0 698 898 A1 2/1996

OTHER PUBLICATIONS

U.S. Appl. No. 11/279,673, filed Apr. 13, 2006, Low et al.
U.S. Appl. No. 11/383,285, filed May 15, 2006, Bravard et al.

* cited by examiner

*Primary Examiner*—Elvin Enad
*Assistant Examiner*—Lisa Klaus
(74) *Attorney, Agent, or Firm*—Oblon, Spivak, McClelland, Maier & Neustadt, P.C.

(57) ABSTRACT

The invention relates to an actuating device (1) for an electrical switch device comprising a body (10) upon which is mounted a hand lever (2) that rotates about a main axis (A), cooperating with a transmission shaft (3) able to control the opening or the closing of electrical contacts of the electrical switch device and elastic linking means between the hand lever (2) and the transmission shaft (3). The device also comprises means (7) for locking the rotation of the hand lever (2) with respect to the body (10), used when an angular divergence between the hand lever (2) and the transmission shaft (3) exceeds a specified threshold. The purpose of the invention is to limit the damage to the hand lever and to the electrical device when an operator attempts to return the hand lever (2) to its "Off" position whilst the contacts are welded and to prevent the beginning of electrical arcing if the operator should succeed in unsticking the contacts when rotating the hand lever 2.

12 Claims, 2 Drawing Sheets

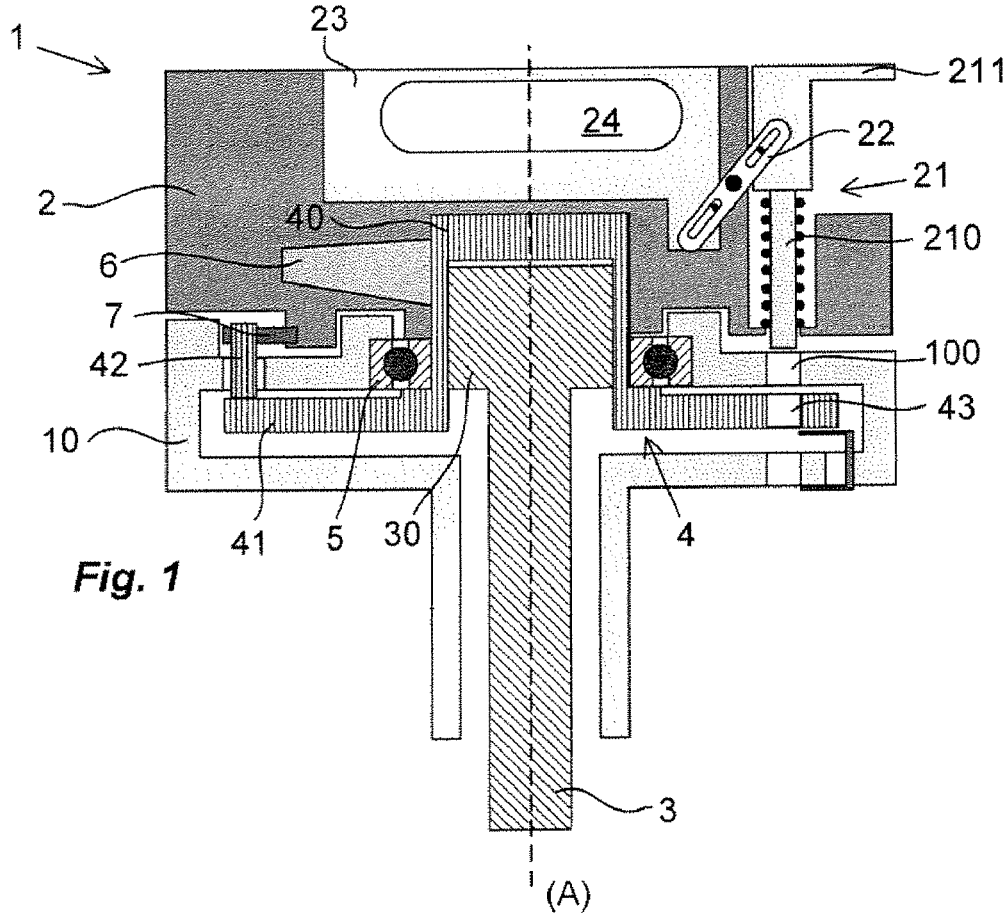
Fig. 1
Fig. 3
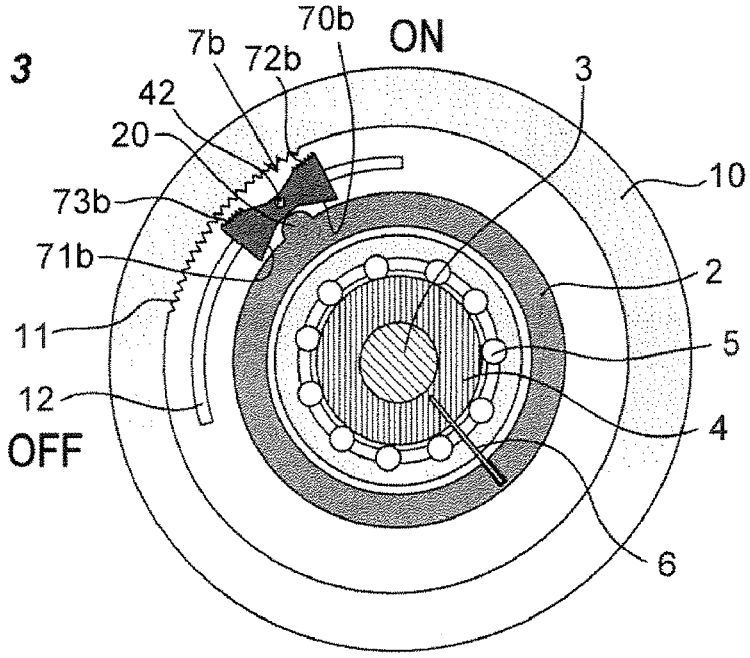

ACTUATING DEVICE FOR AN ELECTRICAL SWITCH DEVICE WITH ROTATIONAL LOCKING MEANS

BACKGROUND OF THE INVENTION

1. Field of the Invention

The present invention relates to an actuating device for an electrical switch device, such as for example a circuit breaker. The invention also relates to an electrical switch device incorporating such an actuating device. The actuating device is for example remote with respect to the electrical switch device.

2. Description of the Prior Art

For safety reasons, the locking of the hand lever of an actuating device for an electrical switch device must be possible only when the hand lever is in the "Off" position. For this purpose, it is known to provide the actuating device with a device for locking the hand lever when the latter is in the "Off" position. In order to maintain the hand lever in the locked position, padlocks are hooked though one or more openings formed on the hand lever. The U.S. Pat. No. 6,423,912 describes such a locking device in particular.

However, when the contacts of the electrical switch device are welded to each other as the result, for example, of a short circuit, the rotational locking of the hand lever in the "Off" position must be made impossible given that an operator could believe that the contacts are open whereas in reality the latter are closed because they are welded.

The U.S. Pat. No. 6,797,903 and U.S. Pat. No. 5,222,382 (or the corresponding EP 0 450 699) describe solutions making it possible to prevent such a situation. In these patents, the rotation of the hand lever towards its "Off" position whilst the contacts are welded together causes the rotation of an element that comes to obturate the passage through which a locking device must pass. Even if the operator forces the hand lever in order to return it to the "Off" position, locking remains impossible.

However, by forcing the hand lever in order to attempt to return it into its off position whilst the contacts are welded together, the operator can damage the hand lever and the electrical switch device. Moreover, if by forcing the hand lever the operator succeeds in unsticking the contacts, he risks creating electrical arcs which can prove to be dangerous.

The document EP 0 472 477 describes a device for locking a circuit breaker handle when the contacts are welded. When the contacts are welded, after passing through a dead point by manual action, the handle becomes immobilized and is locked in a stable intermediate position, situated between the open position and the closed position. In this intermediate position, a deformable part deforms under the action of the handle such that it comes to butt against a fixed stop piece of the device.

In such a device, the deformable part is particularly stressed and it carries out the double function of detection of the torque when an operator attempts to return the handle towards the open position whilst the contacts are welded and of limiting the torque by blocking the rotation of the handle against the fixed stop when the contacts are welded. The part must thus exhibit both a certain flexibility and a certain rigidity in order to carry out both functions. Moreover, when there is a welding of the contacts, in the intermediate position of the handle, the deformable part is stressed permanently, which can cause a return to the open position if the part is worn even though the contacts are welded.

SUMMARY OF THE INVENTION

The purpose of the invention is therefore to propose a reliable actuating device which avoids damaging the hand lever and the electrical device when an operator attempts to return the hand lever to its "Off" position whilst the contacts are welded together and which prevents the start of electrical arcing if the operator succeeds in unsticking the contacts on rotating the hand lever towards its "Off" position.

This purpose is achieved by an actuating device for an electrical switch device comprising:

- a body upon which is mounted a hand lever that rotates about a main axis, cooperating with a transmission shaft able to control the opening or the closing of electrical contacts of the electrical switch device,
- elastic linking means between the hand lever and the transmission shaft,
- means for locking the rotation of the hand lever with respect to the body, used when an angular divergence between the hand lever and the transmission shaft exceeds a specified threshold, said device being characterized in that
- the locking means comprise a locking device that is rotational about an axis parallel with the main axis, and in that
- the locking device is made to pivot by the hand lever, in a temporary manner, each time that the angular divergence between the hand lever and the transmission shaft exceeds a specified threshold.

In comparison with the disclosure of the document U.S. Pat. No. 5,222,382 referred to above, the rotational locking of the hand lever in the device of the invention is therefore carried out with respect to the body of the device. Moreover, in comparison with the device described in the document EP 0 472 477, the functions of detection and limitation of the torque are carried out by two different means which allows the functioning of the device over the course of time to be made more reliable. Moreover, in the invention, the locking device is stressed only temporarily and locks the hand lever only at each attempt to return the hand lever to its off position whilst the contacts are welded. The hand lever does not occupy any intermediate position in which the locking device is permanently stressed.

According to one feature, the locking device is integral in rotation with the transmission shaft.

According to another feature, the locking device is mobile between a position of rest in which it is integral in rotation with the hand lever and a working position in which, pivoted by the hand lever when the angular divergence between the hand lever and the transmission shaft exceeds the specified threshold, it presses against the body of the device and locks the rotation of the hand lever.

According to another feature, the locking device comprises at least one cam against which a part of the hand lever bears in order to be driven in pivoting.

According to another feature, the locking device can comprise two cams formed symmetrically with respect to a plane passing through its axis and the main axis. The part of the hand lever, by following one of the cams, drives the locking device in pivoting in one direction or in the other. The locking device, by pivoting, then bears against the body of the device and therefore locks the rotation of the hand lever. With two symmetrical cams, a locking device of this configuration makes it possible to lock the hand lever in one direction of rotation or in the other.

According to the invention, the pivoting of the locking device takes place in the direction opposite to that of the rotation of the hand lever.

According to the invention, the locking device comprises teeth able to cooperate with corresponding teeth formed on the body.

According to one feature, the locking device is driven from its working position towards its rest position by a return spring. The locking device can also be returned to its position of rest naturally by following the cam in the reverse direction.

According to the invention, the elastic linking means are for example constituted by a leaf spring. The use of other linking means can be envisaged. The leaf spring has for example a trapezoidal shape in order to better distribute the forces being applied between the hand lever and the transmission shaft.

The actuating device described above is perfectly adapted for the control of an electrical switch device and can be mounted on a cabinet in which the electrical switch device is placed. In this case, the transmission shaft is integral with a mobile rotary member of the electrical switch device.

BRIEF DESCRIPTION OF THE DRAWINGS

Other features and advantages will appear in the following detailed description relating to an embodiment given by way of example and shown in the appended drawings in which:

FIG. 1 is a diagrammatic representation in cross section of the actuating device according to the invention.

FIG. 2A shows the state of the hand lever in normal operation whilst FIG. 2B shows the use of the rotational locking means of the hand lever when the contacts of the electrical switch device are welded.

FIG. 3 shows in a diagrammatic manner the functioning of a variant of the rotational locking means of the hand lever.

DESCRIPTION OF THE PREFERRED EMBODIMENTS

Figure 2A:
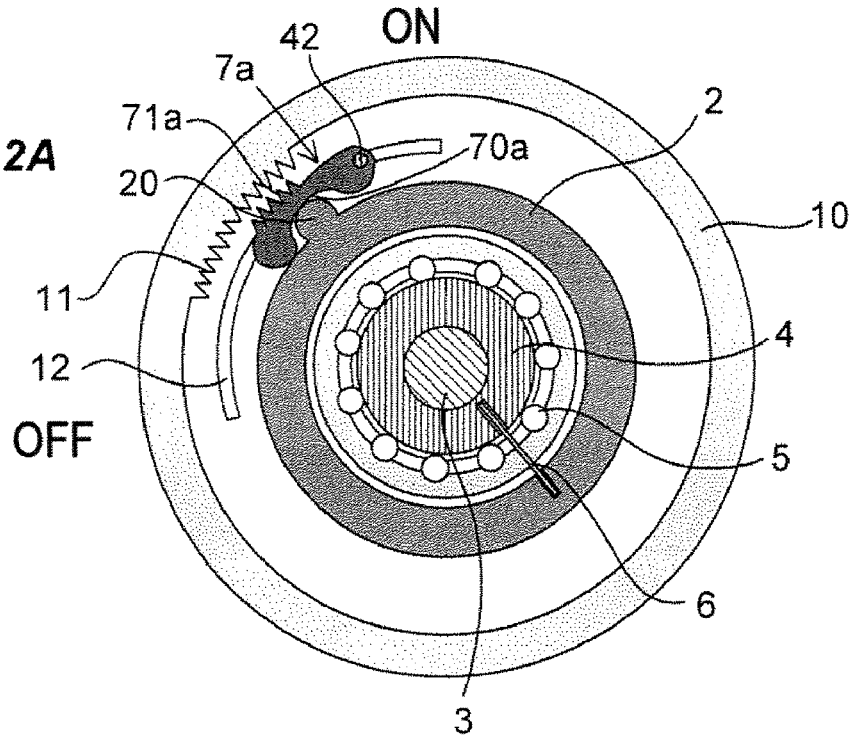
FIGS. 2A and 2B show the functioning of the invention in a diagrammatic manner.

The actuating device 1 according to the invention is for example remote with respect to the electrical switch device and mounted on the door of an electrical cabinet in order to allow the operator to operate the electrical device without opening the electrical cabinet. Such a cabinet can be opened only if the actuating device 1 is in an "Off" position (OFF in FIGS. 2A, 2B and 3). Such actuating devices are well known in the prior art and are for example used for remote circuit breaker control.

With reference to FIG. 1, a remote actuating device 1 according to the invention comprises a body 10 on which is mounted a rotary hand lever 2 whose rotational movement about a main axis (A) is integral with that of a transmission shaft 3 whose task is to transmit the movement of the hand lever 2 to a rotary member of the electrical switch device present in the cabinet, said rotary member of the electrical device controlling the opening or the closing of the electrical contacts in the electrical switch device. The transmission shaft 3 is integral with a shaft support 4 having the shape of a hat composed of a hood 40 receiving the head 30 of the transmission shaft 3, extended towards the exterior by an annular plate 41. The shaft support 4 is disposed in a coaxial manner with respect to the transmission shaft 3. A ball bearing 5 is positioned coaxially between the body 10 and the shaft support 4 in order to allow the rotation of the transmission shaft 3 with respect to the body 10, The shaft support 4 is integral in rotation with the hand lever 2 by the intermediary of elastic linking means, such as for example a leaf spring 6. In normal functioning, the leaf spring 6 has the task of transmitting to the shaft support 4, and therefore to the transmission shaft 3, the rotational movement imparted to the hand lever 2 by the operator or, in the case of circuit breaking, the rotational movement of the transmission shaft 3 to the hand lever 2.

The leaf spring 6 has sufficient flexibility for, in normal operation, joining together in rotation the hand lever 2 and the shaft support 4 and for, when the shaft support is immobilized due to a welding between the contacts, flexing when a rotational torque is applied to the hand lever 2.

The leaf spring 6 is for example disposed in an axial plane of the device 1 and has, for example, a trapezoidal shape in order to better distribute the forces over its length when it flexes. The small base of the leaf spring 6 is for example connected to the hand lever 2 whilst the large base is connected to the shaft support 4.

The shaft support 4 furthermore comprises a stud 42 protruding above its annular plate 41 along an axis parallel with the main axis (A), traversing the body 10 and forming a spindle on which is mounted a locking device 7, 7*a*, 7*b*. During the rotation of the transmission shaft 3 and therefore of the shaft support 4, the stud 42 follows a slot 12 formed through the body 10.

Figure 2B:
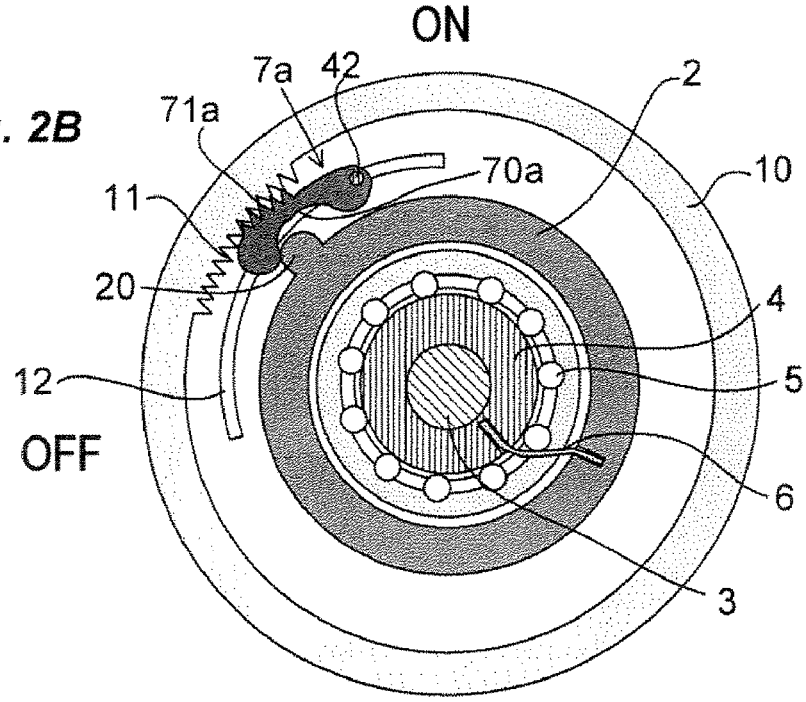

According to a first embodiment shown in FIGS. 2A and 2B, the locking device 7*a* is constituted by a lever mounted such that it rotates on the stud 42 and is able to pivot in a plane perpendicular to the main axis (A) between a position of rest and a working position.

The locking device 7*a* comprises a recess in which is engaged a part of the hand lever 2, for example a protuberance 20 formed on the latter. The recess defines a cam 70*a* upon which the protuberance 20 bears in order to pivot the locking device 7*a* about its axis when the contacts are welded and therefore when the transmission shaft and the shaft support are immobilized. The rotation of the hand lever 2 therefore results in the pivoting of the locking device 7*a* until the latter comes into its working position, bearing against the body 10 of the device 1. The rotation of the hand lever 2 in a direction moving from its "On" (ON) position towards its "Off" (OFF) position results in a pivoting of the locking device 7*a* in the opposite direction.

The locking device 7*a* furthermore comprises teeth 71*a* for engaging with corresponding teeth 11 formed on the body 10 of the device 1 when it bears against the body 10.

In normal functioning, the rotation of the hand lever 2 between its "On" (ON) and "Off" (OFF) positions is accompanied by a rotation of the transmission shaft 3 and of the shaft support 4 bearing the locking device 7*a*, the transmission of the movement being carried out by the intermediary of the leaf spring 6. The angular divergence between the hand lever 2 and the shaft support 4/transmission shaft 3 assembly is therefore zero.

When the contacts are welded together as the result, for example, of a short circuit, the transmission shaft 3, the shaft support 4 and therefore the locking device 7*a* are immobilized and the hand lever 2 is therefore in its "On" (ON) position. The application of a rotary torque on the hand lever 2 in order to return it to its "Off" (OFF) position results in a flexion of the leaf spring 6 and therefore in a rotation of the hand lever 2 through a certain angle with respect to the shaft support 4. The angular divergence between the hand lever 2 and the shaft support 4/transmission shaft 3 assembly increases under the application of this rotational torque. On rotating the hand lever 2 with respect to the shaft support 4 and on increasing the angular divergence, the protuberance 20 presses against the cam 70*a* of the locking device 7*a* starting the pivoting of the locking device 7*a* in the direction opposite to that of the rotation of the hand lever 2. When the angular divergence between the hand lever 2 and the shaft support 4/transmission shaft 3 assembly exceeds a specified threshold, the locking device 7*a*, by pivoting, assumes its working position and therefore comes to bear against the body 10 of the device 1, its teeth 71*a* cooperating with the corresponding teeth 11 of the body 10 (FIG. 2B). Beyond this threshold, the rotation of the hand lever 2 with respect to the body 10 is impossible, the protuberance 20 of the hand lever 2 then coming to butt against the locking device 7*a* (FIG. 2B).

According to a second embodiment shown in FIG. 3, the locking device 7*b* is mounted such that it rotates on the stud 42 and has a butterfly shape having two wings that are symmetrical with respect to the axial plane passing though its axis of rotation, forming between them a recess defining two symmetrical cams 70*b*, 71*b*. A part of the hand lever 2, for example a protuberance 20 formed on the latter, is engaged in the recess of the locking device 7*b*. This locking device 7*b* furthermore comprises two symmetrical bearing surfaces, each one formed on an edge opposite to a cam 70*b*, 71*b*. These two bearing surfaces are provided with teeth 72*b*, 73*b* able to cooperate with corresponding teeth 11 of the body 10 of the device 1.

The functioning of the invention with the locking device according to this second embodiment is identical to the preceding functioning.

In normal functioning, the rotation of the hand lever 2 results in a rotation of the shaft support 4 and of the transmission shaft 3. The angular divergence between the hand lever 2 and the shaft support 4/transmission shaft 3 assembly is zero.

When the contacts are welded together and the locking device 7*b* integral with the shaft support 40 is immobilized, a rotation of the hand lever 2 in either direction modifies the angular divergence between the hand lever 2 and the shaft support 4/transmission shaft 3 assembly, this modification being allowed by a flexion in one direction or the other of the leaf spring 6 linking the hand lever 2 to the shaft support 4. The protuberance 20 then engages on one of the cams 70*b*, 71*b* of the locking device 7*b* in order to start the pivoting of the locking device 7*b* in the direction opposite to that of the rotation of the hand lever 2. When the angular divergence between the hand lever 2 and the shaft support 4/transmission shaft 3 assembly is greater than a specified threshold, the locking device 7*b*, in its working position, comes to bear against the body 10 of the device 1 by one of its bearing surfaces, its teeth 72*b*, 73*b* cooperating with the corresponding teeth 11 formed on the body 10 in order to lock the rotation of the hand lever 2. Beyond this threshold, the rotation of the hand lever 2 with respect to the body 10 is therefore impossible, the protuberance 20 of the hand lever 2 coming to butt against the locking device 7*b*.

In this second embodiment, because of the two symmetrical cams 70*b*, 71*b*, the locking device 7*b* has the advantage of being able to be actuated by pivoting in one direction or the other according to the direction of the forced rotation of the hand lever 2.

According to the invention, the return of the locking device 7, 7*a*, 7*b* from its working position to its position of rest is for example achieved naturally during the return to the hand lever 2 to the "On" (ON) position, the protuberance 20 of the latter following the cam in the reverse direction until the angular divergence between the hand lever 2 and the shaft support 4/transmission shaft 3 assembly returns to a value close to zero. According to a variant embodiment, the locking device 7, 7*a*, 7*b* can also be mounted on a return spring (not shown) in order to be returned into the position of rest.

The actuating device 1 furthermore comprises a locking device mounted on the hand lever 2 and making it possible to lock the rotation of the hand lever 2 when the latter is in its "Off" (OFF) position. For safety reasons, the locking of the hand lever 2 must be possible only when the hand lever 2 is in its "off" (OFF) position, For this purpose, the locking device comprises a sliding element 23 integral with the hand lever 2 and extractable from the latter and a locking device 21, both mobile in translation along the main axis (A) between an unlocked position and a position of locking the rotation of the hand lever 2. The locking device 21 comprises for example a rod 210 able to traverse an orifice 100 of the body and an orifice 43 of the shaft support 4 in order to lock the hand lever 2 in rotation when it is in its "Off" (OFF) position.

The sliding element 23 is provided with an opening 24, for example of oblong shape, through which it is possible to pass padlocks in order to prevent the return of the sliding element 23 into its housing and therefore from locking the actuating device 1. This sliding element 23 is mobile in translation along the main axis (A). The movement of translation of the locking device 21 is accompanied by a corresponding movement of the sliding element 23 by using a mechanism mounted on the hand lever 2. This drive mechanism constituted by a rod 22 makes it possible to convert the movement of translation of the locking device 21 along the main axis (A), and in a specified direction, into a movement of translation of the sliding element 23 along the main axis (A) and in the direction opposite to that of the locking device 21. When the hand lever 2 is in its "Off" position, pressing on a button 211 of the locking device 21 therefore results in an extraction of the sliding element 23.

It is of course understood that it is possible, without departing from the scope of the invention, to imagine other variants and improvements in detail and even to envisage the use of equivalent means.

The invention claimed is:

1. Actuating device (1) for an electrical switch device comprising:

a body (10) upon which is mounted a hand lever (2) that rotates about a main axis (A), cooperating with a transmission shaft (3) able to control the opening or the closing of electrical contacts of the electrical switch device, elastic linking means between the hand lever (2) and the transmission shaft (3), means (7) for locking the rotation of the hand lever (2) with respect to the body (10), used when an angular divergence between the hand lever (2) and the transmission shaft (3) exceeds a specified threshold, wherein the locking means comprise a locking device (7, 7*a*, 7*b*) that is rotational about an axis parallel with the main axis (A), and in that the locking device is made to pivot by the hand lever (2), in a temporary manner, each time that the angular divergence between the hand lever (2) and the transmission shaft (3) exceeds a specified threshold.

2. Device according to claim 1, wherein the locking device (7, 7*a*, 7*b*) is integral in rotation with the transmission shaft (3).

3. Device according to claim 1 or 2, wherein the locking device (7, 7*a*, 7*b*) is mobile between a position of rest in which it is integral in rotation with the hand lever (2) and a working position in which, pivoted by the hand lever (2) when the angular divergence between the hand lever (2) and the transmission shaft (3) exceeds the specified threshold, it presses against the body (10) of the device and locks the rotation of the hand lever (2).

4. Device according to claim 3, wherein the locking device (7, 7*a*, 7*b*) is driven from its working position towards its rest position by a return spring.

5. Device according to claim 1, wherein the locking device (7, 7*a*, 7*b*) comprises at least one cam (70*a*, 70*b*, 71*b*) against which a part (20) of the hand lever (2) bears in order to be driven in pivoting.

6. Device according to claim 1, wherein the locking device (7*b*) comprises two cams (70*b*, 71*b*) formed symmetrically with respect to a plane passing through its axis and the main axis (A), a part of the hand lever (20) being able to bear against one of the cams in order to drive the locking device (7*b*) in pivoting.

7. Device according to claim 1, wherein the pivoting of the locking device (7, 7*a*, 7*b*) takes place in the direction opposite to that of the rotation of the hand lever (2).

8. Device according to claim 1, wherein the locking device (7, 7*a*, 7*b*) comprises teeth (71*a*, 72*b*, 73*b*) able to cooperate with corresponding teeth (11) formed on the body (10).

9. Device according to claim 1, wherein the elastic linking means are constituted by a leaf spring (6).

10. Device according to claim 9, wherein the leaf spring (6) has a trapezoidal shape.

11. Device according to claim 1, wherein the device is remote with respect to the electrical switch device and in that the transmission shaft (3) is integral with a rotary mobile member of the electrical switch device.

12. Electrical switch device controlled by means of an actuating device (1) according to claim 1.

* * * * *